US005400926A

United States Patent [19]

Keller

[11] Patent Number: 5,400,926

[45] **Date of Patent: * Mar. 28, 1995**

[54] DISPENSING CARTRIDGE WITH STORAGE CYLINDER AND FEEDING PISTON

[76] Inventor: Wilhelm A. Keller, Obstgartenweg 9, CH-6402 Merlischachen / Schweiz, Switzerland

[ * ] Notice: The portion of the term of this patent subsequent to Jan. 12, 2010 has been disclaimed.

[21] Appl. No.: 93,902

[22] Filed: Jul. 20, 1993

Related U.S. Application Data

[63] Continuation of Ser. No. 827,466, Jan. 29, 1992, abandoned.

[30] Foreign Application Priority Data

Jan. 29, 1991 [CH] Switzerland ..... 00269/91

[51] Int. Cl.[6] ..... B65D 83/00

[52] U.S. Cl. ..... 222/327; 222/386

[58] Field of Search ..... 222/326, 327, 386, 386.5, 222/389; 604/125; 239/320–322

[56] References Cited

U.S. PATENT DOCUMENTS

| | | | |
|---|---|---|---|
| 3,066,836 | 12/1962 | Trumbull | 222/327 |
| 3,217,936 | 11/1965 | Abplanalp | 239/322 X |
| 4,645,098 | 2/1987 | Hoffmann | 222/386 |
| 4,792,065 | 12/1988 | Soehnlein et al. | 222/386 X |
| 4,819,836 | 4/1989 | Meckenstock | 222/386 |
| 4,834,268 | 5/1989 | Keller | 222/327 |
| 4,854,485 | 8/1989 | Collins | 222/327 X |
| 4,951,848 | 8/1990 | Keller | 222/386 |
| 5,022,563 | 6/1991 | Marchitto et al. | 222/327 |
| 5,042,695 | 8/1991 | Battegazzore | 222/386 X |
| 5,165,572 | 11/1992 | Bath | 222/327 X |
| 5,178,305 | 1/1993 | Keller | 222/386 |

FOREIGN PATENT DOCUMENTS

| | | | |
|---|---|---|---|
| 0058989 | 9/1982 | European Pat. Off. | 222/327 |
| 0351441 | 1/1990 | European Pat. Off. | 222/327 |
| 1044165 | 11/1953 | France | 417/550 |
| 3435576 | 4/1986 | Germany | 222/386 |

*Primary Examiner*—Andres Kashnikow
*Assistant Examiner*—Anthoula Pomrening
*Attorney, Agent, or Firm*—Ostrolenk, Faber, Gerb & Soffen

[57] ABSTRACT

A dispensing cartridge comprising a storage cylinder and a feeding piston. A sealing ring is inserted in the wall of the piston at a distance from the end of the feeding piston facing the cartridge contents. The end is additionally provided with a sealing lip and a V-shaped, circular groove disposed between the sealing lip and the piston wall. The bottom surface of the feeding piston facing the cartridge contents is provided with radially extending venting grooves which communicate with a venting bore, while the other ends of the venting grooves communicate with the V-shaped circular groove of the sealing lip. With the feeding piston sealed in this matter, outflow of the contents is effectively prevented even if aggressive substances, substances having a low viscosity, or substances having extremely high flow properties are contained. Moreover, the ability to store such substances is strongly increased.

16 Claims, 2 Drawing Sheets

DISPENSING CARTRIDGE WITH STORAGE CYLINDER AND FEEDING PISTON

This is a continuation of application Ser. No. 07/827,466, filed Jan. 29, 1992, now abandoned.

BACKGROUND OF THE INVENTION

The present invention refers to a dispensing cartridge comprising a storage cylinder and a feeding piston in whose cylinder wall a sealing ring is inserted. Such a dispensing cartridge is known from EP-A-344,491 of the same applicant. At the time, this dispensing cartridge represented a progress over the state of the art, but tests have shown that it is capable of being improved. In Swiss Patent Application no. 02 079/90-1, disclosing a feeding piston having venting bores, a characteristic feature was essentially improved in order to prevent that material flowing out when the feeding piston is thrust forward and the venting bore is closed which will lead to disturbing soiling, and measures were further taken in order to ensure a quicker and simpler closure.

By contrast, the present invention is directed to improving another property of the dispensing cartridge, i.e. the preservation of the enclosed composition, more particularly the long-term storage of aggressive substances. While a sealing of the feeding piston in the cartridge wall by means of a sealing ring, generally an O-ring, is sufficient for many applications, aggressive substances which can attack this O-ring or substances having a low viscosity, i.e. extreme flowing properties, may result in situations where the use of a single sealing element poses a problem. Moreover, there are substances which are sensitive to the ingress of water vapor or of gases and thereby change their chemical properties.

SUMMARY OF THE INVENTION

Based upon a dispensing cartridge according to the state of the art, it is an object of the present invention to improve the same mainly with respect to effectively preventing an outflow or a detrimental effect upon the cartridge contents. This object is attained by a dispensing cartridge comprising a storage cylinder and a feeding piston in whose wall a sealing ring is inserted. The sealing ring is inserted at a distance from the end of the feeding piston facing the cartridge contents, and the end is additionally provided with a sealing lip. According to a further development constituting a preferred embodiment, damages to the sealing lip are effectively prevented. In a further embodiment, leakage, due to damage of the sealing lip, is prevented.

BRIEF DESCRIPTION OF THE DRAWINGS

The invention is explained in more detail hereinafter with reference to the following drawings.

DETAILED DESCRIPTION OF THE INVENTION

Figure 3:
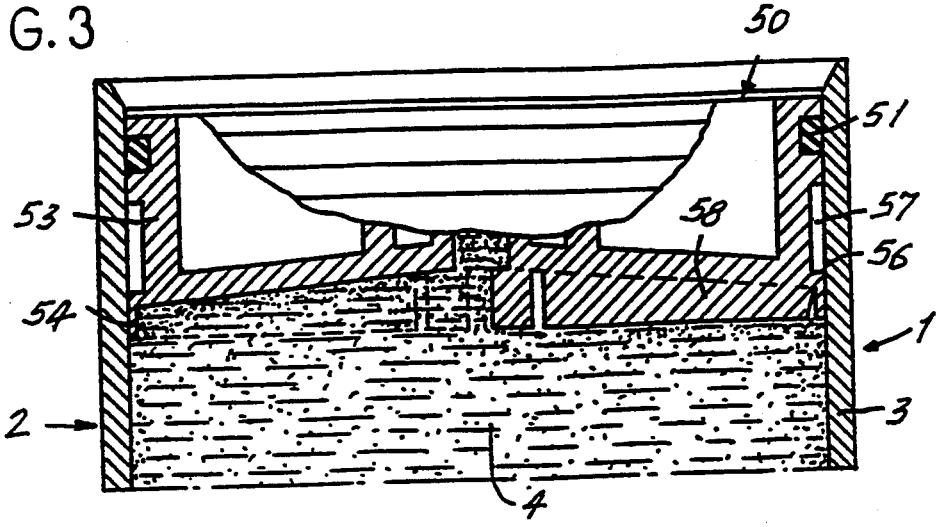
FIG. 3 shows a cross-section of the installed feeding piston in its initial position before dispensing.

FIG. 3 illustrates dispensing cartridge 1 with storage cylinder 2 and wall 3, the bottom of the storage cylinder ending in a non-represented closable nozzle. Cylinder 2 accommodates a precisely weighed quantity of the enclosed composition 4, as well as a feeding piston 50 which is generally made of a soft material, preferably a synthetic material. In contrast to the feeding piston according to EP-A-344,491 or according to the already mentioned Swiss Patent Application no. 02 079/90, the feeding piston is sealed with respect to the wall 3 of storage cylinder 2 by two sealing elements instead of a single one which is provided at the product end of the feeding piston.

The otherwise usual sealing ring, i.e. O-ring 51, is now inserted into the circumferential surface 53 of the cylinder at a distance from the end 52 of the feeding piston, preferably at its other end. The product end 52 of the feeding piston is provided with a circular sealing lip 54 having an adjoining circular V-shaped groove 55 (see FIG. 2), which is integral with piston wall 53. As appears especially in FIG. 2, the front side of the sealing lip is level with the front surface of the piston.

At the location where sealing ring 51 is inserted, the piston wall 53 is thickened, the external circumference of the thickening being the same as that of base 56 of sealing lip 54, so that a circular space 57 (see FIG. 3) is formed between the base and the thickening where the O-ring is inserted. Hollow space 57 serves as a collecting chamber for the wall layer of the enclosed composition which is scraped off by the O-ring, or for a small amount of the enclosed composition which might nevertheless pass beneath the sealing lip.

While the double seal is effective with any kind of feeding piston and may be used if required by the enclosed composition, the utilization of such a double seal is particularly efficient in conjunction with a feeding piston whose bottom is effectively vented. In particular, in accordance with the present preferred embodiment, the double seal is preferable when the bottom is provided with venting grooves and a venting bore. In contrast, other known venting methods using venting needles or the like entail the risk of damaging the sealing lip. The entire venting system with the resulting advantages is described in detail in the already mentioned Swiss patent application, which is hereby referred to, so that various elements are only summarily mentioned here.

Figure 2:
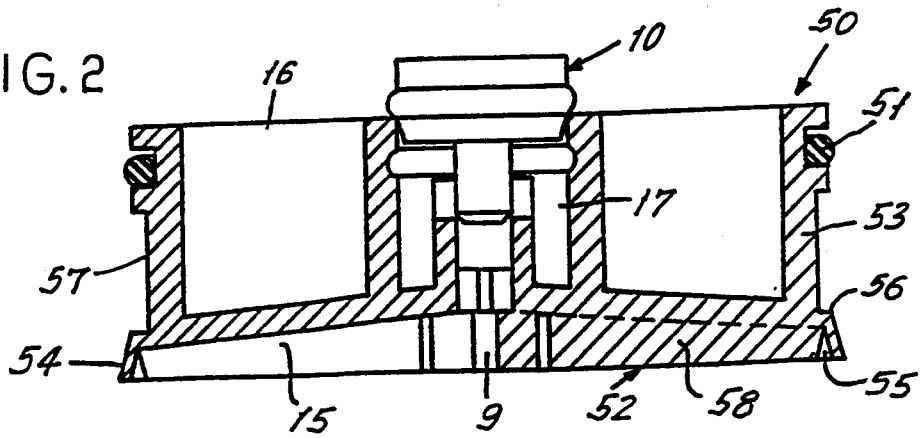
FIG. 2 shows a cross-section according to line II—II in FIG. 1.

FIG. 2 shows the bottom surface 58 facing the cartridge contents 4, the surface having a flat configuration rather than being recessed towards venting bore 9, as opposed to the above-mentioned state of the art, in order to obtain a complete dispensing of the enclosed composition. Venting bore 9 is capable of being closed by a closure 10 which is described in detail in the above-mentioned Swiss patent application, and which also serves to seal off a similar overflow chamber 17.

Figure 1:
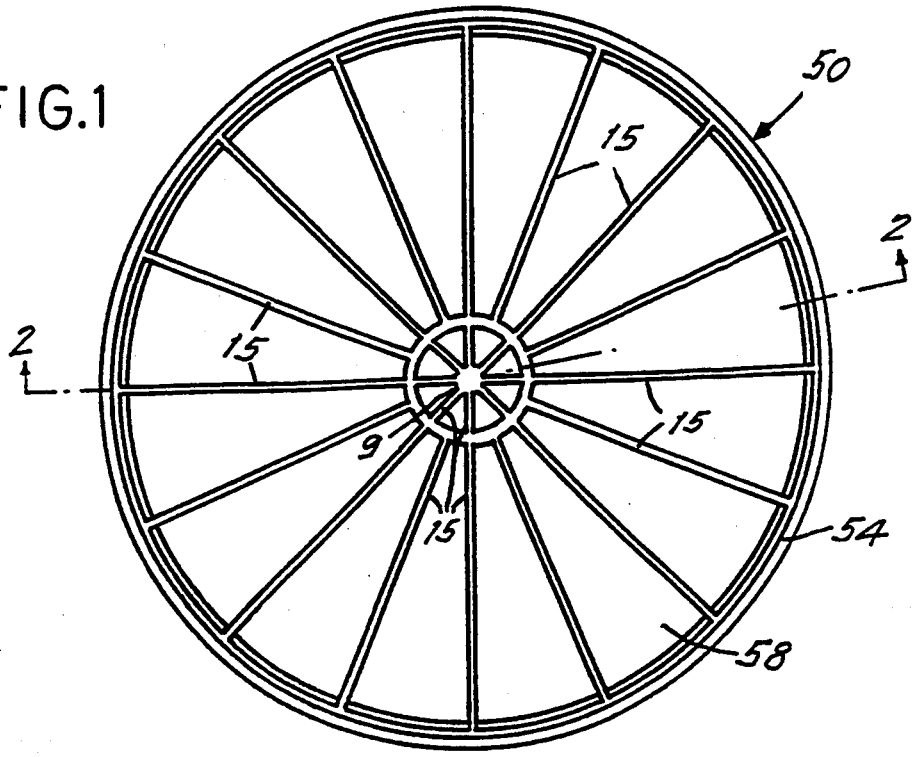
FIG. 1 shows a view of the feeding piston from below.

As shown in FIGS. 1 and 2, bottom surface 58 of the piston comprises an array of radially extending venting grooves 15 whose depth is continuously increasing towards venting bore 9 in the present embodiment. Tests have shown that grooves 15 can also have a constant depth in order to function correctly. As appears in FIG. 1, the number of radially disposed grooves 15 is reduced toward the center area in order to facilitate manufacture. Moreover, the feeding piston is also provided with the radial ribs 16 as described in the abovementioned Swiss application.

It is important for a complete air evacuation that the circular groove 55 is vented as well. This air evacuation is achieved by the fact that the outer ends of radially extending grooves 15 communicate with V-shaped groove 55. The air is thereby allowed to be completely pressed out of V-shaped groove 55 towards venting bore 9 where it escapes.

The complete venting of the piston surface allows a precise observance of the proportioning ratio, which is required in particular for multiple dispensing cartridges having storage cylinders of different diameters, i.e. different volumes. As already mentioned, the O-ring or another sealing element is not exposed to the enclosed composition during the storage period, or only to a minor degree, which is particularly important in the case of long storage periods or if aggressive products are concerned. On the other hand, the double seal system also effectively prevents a penetration of water vapor or of gases which might impair the chemical stability of the enclosed composition.

As opposed to traditional methods, where an often incomplete venting results and/or the sealing element is often damaged by the insertion of venting needles or the like between the piston and the cylinder wall, the present sealing lip is normally not damaged, due to a central venting arrangement, when the piston is pushed in.

Figure 4:
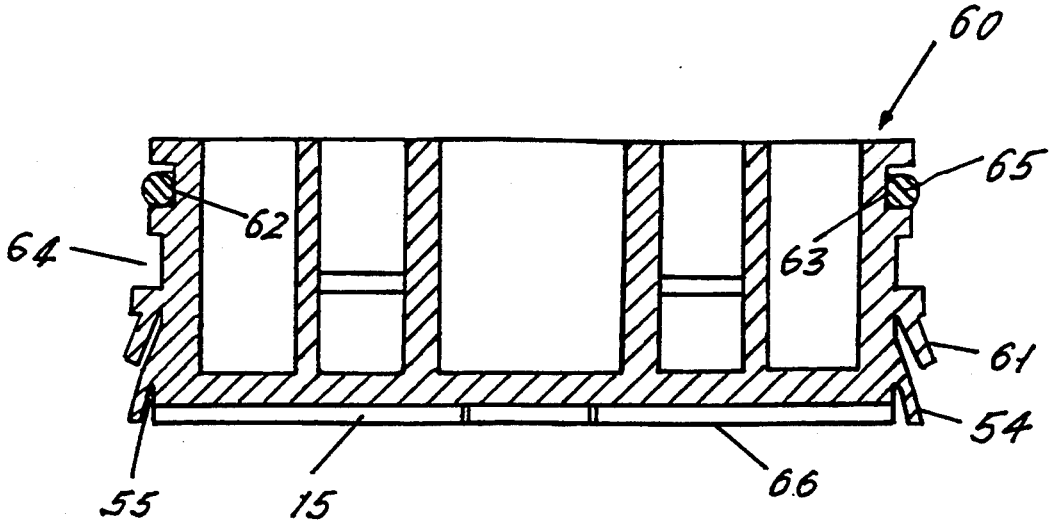
FIG. 4 shows a cross-section of a further embodiment.

However, it is possible that the sealing lip is damaged during manufacture, transport or when the piston according to FIGS. 1–3 is pushed in improperly, which may have unpleasant consequences. According to FIG. 4, two sealing lips are provided in order to prevent such damages.

In addition to the first sealing lip 54 of the first piston 50, feeding piston 60 is provided with a second sealing lip 61 which may be somewhat smaller than the first one. Between sealing lip 54 and the bottom 66 of the piston, which is flat in this embodiment, the same circular groove 55 as in the first embodiment is provided. The same venting grooves 15 as in the first embodiment communicate with the groove 55 for example (See FIG. 1).

On one hand, the second sealing lip represents a safety in case of a damage to the first sealing lip. On the other hand, it has a further function if compositions having a very low viscosity are used. In accordance with the first embodiment, O-ring 65 is inserted in a recess 63 of wall 62 which is disposed near the end opposite the sealing lips and which has an adjoining second recess 64.

The use of two sealing lips is not limited to the embodiment having an overflow chamber, but it is suitable for all kinds of feeding pistons in dispensing cartridges.

I claim:

1. A dispensing cartridge comprising:

a storage cylinder for holding contents to be dispensed;

a feeding piston slidably disposed within said cylinder including a wall and an end facing the contents contained within said cylinder; and means for forming a seal between said storage cylinder and said feeding piston, said means comprising:

a first sealing lip located on said end of said feeding piston in contact with the contents contained in the cylinder; and a second sealing lip located on said feeding piston and spaced above said first sealing lip, wherein said first and second sealing lips extend toward the contents contained in the cylinder when said piston is slid toward the contents to be dispensed;

wherein said first and second sealing lips extend from said piston at first and second base portions, respectively, a first diameter of said first base portion being smaller than a second diameter of said second base portion.

2. The dispensing cartridge of claim 1, wherein between said first sealing lip and said piston wall, a circular V-shaped groove is provided.

3. The dispensing cartridge of claim 2, wherein said piston end has a bottom surface facing the cartridge contents, said bottom surface being provided with radially extending venting grooves, each having opposed inner and outer ends, the inner ends of each of the venting grooves communicating with a centrally disposed venting bore and the outer ends of each of the venting grooves communicating with said V-shaped circular groove.

4. The dispensing cartridge of claim 3, wherein said bottom surface of said feeding piston is flat.

5. The dispensing cartridge of claim 3, wherein said venting grooves have a constant depth.

6. The dispensing cartridge of claim 3, wherein the depth of said venting grooves continuously increases from the outer ends towards said venting bore.

7. The dispensing cartridge of claim 3, wherein an overflow chamber is disposed around said venting bore, said overflow chamber, as well as said venting bore, being sealed by a closure.

8. The dispensing cartridge of claim 1, further comprising a sealing ring located in said piston wall above said second sealing lip.

9. The dispensing cartridge of claim 8, wherein said sealing ring is inserted in a thickening of said piston wall, and a hollow space is formed between said thickening and said second sealing lip, said space serving as a collecting chamber.

10. The dispensing cartridge of claim 1, wherein said end of said feeding piston comprises a flat front surface, and said first sealing lip includes a front edge which is level with said flat front surface.

11. The dispensing cartridge of claim 1, wherein said second sealing lip is smaller than said first sealing lip.

12. The dispensing cartridge of claim 1, wherein said second sealing lip is shorter than said first sealing lip.

13. A dispensing cartridge comprising:

a storage cylinder for holding contents to be dispensed;

a feeding piston slidably disposed within said cylinder, said feeding piston including an end, said end having a bottom surface facing the contents contained within said cylinder; and a plurality of radially extending venting grooves provided in said bottom surface, each of said venting grooves having opposed inner and outer ends, the inner ends communicating with a centrally disposed venting bore, the depth of said venting grooves continuously increasing from the outer ends toward said venting bore.

14. The dispensing cartridge of claim 13, wherein said piston has a wall, and a sealing ring is located in said piston wall.

15. A dispensing cartridge comprising:

a storage cylinder, a feeding piston including an end, said end having a bottom surface facing the cartridge contents, said bottom surface being provided with radially extending venting grooves, each having opposed inner and outer ends, the inner ends of each of the venting grooves communicating with a centrally disposed venting bore and the outer ends of each of the venting grooves communicating with a V-shaped circular groove;

a sealing ring, inserted in a wall of said feeding piston, said sealing ring being inserted at a distance from the end of the feeding piston facing the cartridge contents;

a sealing lip additionally provided on said end, the V-shaped groove formed between the lip and the piston wall, and an overflow chamber disposed annularly around said venting bore, said overflow chamber, as well as said venting bore, being sealed by closure means which further seals said venting bore from said overflow chamber.

16. The dispensing cartridge of claim 15, wherein said closure means also seals said venting bore within said overflow chamber.

* * * * *